US010195625B2

(12) United States Patent
Lee

(10) Patent No.: US 10,195,625 B2
(45) Date of Patent: Feb. 5, 2019

(54) HETEROGENEOUS CONTENTS MIXING CONTAINER WITH IMPROVED PRODUCTIVITY AND SEALING ABILITY

(71) Applicant: PUM-TECH KOREA CO., LTD, Incheon (KR)

(72) Inventor: Do Hoon Lee, Bucheon-si (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 33 days.

(21) Appl. No.: 15/605,552

(22) Filed: May 25, 2017

(65) Prior Publication Data

US 2017/0348714 A1 Dec. 7, 2017

(30) Foreign Application Priority Data

Jun. 1, 2016 (KR) ..... 10-2016-68365

(51) Int. Cl.
*B05B 11/00* (2006.01)
*A45D 34/00* (2006.01)
(Continued)

(52) U.S. Cl.
CPC ..... *B05B 11/0081* (2013.01); *A45D 34/00* (2013.01); *A45D 34/04* (2013.01); *B05B 11/0032* (2013.01); *B05B 11/3001* (2013.01); *B05B 15/30* (2018.02); *B65D 81/32* (2013.01); *B65D 81/3222* (2013.01); *A45D 2200/056* (2013.01); *A45D 2200/058* (2013.01); *B05B 11/306* (2013.01); *B05B 11/3023* (2013.01);
(Continued)

(58) Field of Classification Search
CPC ..... B05B 11/305; B05B 11/0081; B05B 11/0083; B05B 11/0078; B05B 11/3043; B05B 11/3046; A45D 2200/058; B65D 81/32; B65D 81/3222; B65D 25/087; B65D 2217/00
USPC ..... 222/145.1, 145.5, 464.7
See application file for complete search history.

(56) References Cited

U.S. PATENT DOCUMENTS 1,611,601 A * 12/1926 McCall ..... B05B 11/0078 222/321.5
2,305,286 A * 12/1942 Ward ..... A47J 43/121 215/5
(Continued)

FOREIGN PATENT DOCUMENTS

KR 20-0270335 Y1 4/2002

*Primary Examiner* — Patrick M. Buechner
(74) *Attorney, Agent, or Firm* — Heedong Chae; Lucem, PC

(57) ABSTRACT

A heterogeneous contents mixing container with improved productivity and sealing ability. The container includes a container body for containing a second content and a first content receiving member is formed in the container body to contain a first content. The receiving member includes an upper separation cap and a lower fixing cap. A shoulder is rotatably coupled to the container body and a lift guide member is fixed to the container body and formed with a spiral groove. A lift member moves upwardly by rotation of the shoulder and is formed with a lift protrusion. A pump housing moves upwardly with the lift member. A discharge pump moves upwardly with the pump housing to pump the first and second contents mixed with each other. A push button is coupled to the discharge pump to be movable up or down and is formed with a discharge outlet.

5 Claims, 8 Drawing Sheets

(51) Int. Cl.
*B65D 81/32* (2006.01)
*A45D 34/04* (2006.01)
*B05B 15/30* (2018.01)

(52) U.S. Cl.
CPC ..... *B05B 11/3069* (2013.01); *B05B 11/3074* (2013.01)

(56) References Cited

U.S. PATENT DOCUMENTS 2,533,806 A * 12/1950 Holzapfel ..... B65D 25/087 206/221
5,692,644 A * 12/1997 Gueret ..... B05B 11/0083 206/222
5,860,569 A * 1/1999 Gregoire ..... A61J 1/2093 222/129
2004/0050858 A1* 3/2004 Masuzzo ..... B05B 11/0005 221/251
2004/0195276 A1* 10/2004 Fuchs ..... A61M 15/0028 222/386
2009/0211927 A1* 8/2009 Wu ..... B65D 81/3222 206/219
2012/0292344 A1* 11/2012 Bertin ..... B05B 11/0032 222/153.13
2013/0062353 A1* 3/2013 Tong ..... B65D 25/087 220/500
2017/0181525 A1* 6/2017 Hwang ..... A45D 40/24

* cited by examiner

Prior Art

Prior Art

HETEROGENEOUS CONTENTS MIXING CONTAINER WITH IMPROVED PRODUCTIVITY AND SEALING ABILITY

CROSS-REFERENCE TO RELATED APPLICATION

This application claims the benefit of Korean application No. 10-2016-68365 filed on Jun. 1, 2016 with the Korean Intellectual Property Office, the disclosure of which is incorporated herein by reference.

BACKGROUND

The present invention relates to a heterogeneous contents mixing container with improved productivity and sealing ability, and more particularly, to a heterogeneous contents mixing container where a first content receiving member is divided into an upper part and a lower part while rotating a shoulder formed on an outer side of the mixing container and at the same time, a push button coupled to an upper end of a pump is exposed to an upper part of the mixing container. In addition, the first content receiving member includes an upper separation cap and a lower fixing cap, and first and second connection pipes are integrally formed on the upper separation cap and the lower fixing cap, respectively. The process of assembling a content suction passage is simplified by directly inserting the second connection pipe into the first connection pipe to form the contents suction passage, thereby improving the productivity and the sealing ability of the product.

In general, there are many cases where two or more different contents are mixed and used in order to multiply the efficacy or effect of cosmetics or medicines contained in a container.

However, after the contents are mixed and then the mixed contents are stored in a single container, when the mixed contents are put into circulation or kept, a chemical reaction may occur in the container to cause the mixed contents to coagulate or precipitate, so that a discharge error may occur or the mixed contents may be discolored or deteriorated.

Thus, according to the related art, different contents are kept in separate containers, respectively. Then, after the inlets of the separate containers are opened, the contents are mixed in a separate container for use.

However, the above-described method may be inconvenient to be used and may cause loss of the container. In addition, when the contents stored in separate containers are put into a single container, the contents may flow down and contaminate the surroundings.

Therefore, in recent years, a mixing container has been developed and used such that different contents may be mixed and used by user's operation when necessary, where the different contents are kept in a single container while being isolated from each other and stored in a single container.

A homogeneous contents mixing container according to the related art has been disclosed in Korean Registered Utility Model No. 20-0270335, as shown in FIG. 1. The homogeneous contents mixing container includes an outer container, a liquid discharging part rotatably coupled to an upper portion of the outer container to discharge contents, sealing means coupled to a lower portion of the outer container and having a separation membrane, and an inner container formed therein with a containing space, where a lower cover is mounted, around the lower portion of the outer container to be movable upward, and a cuttable virgin is attached to an upper portion of the lower cover.

However, the virgin is first removed to use the heterogeneous contents mixing container according to the related art. Then, after pressure is applied to the lower cover to break the separation membrane, the upper cover is separated and then, the liquid discharge part must be pressed. Therefore, it is inconvenient to use the heterogeneous contents mixing container according to the related art.

To solve the problems described above, as shown in FIG. 2, a cosmetic container for mixing two kinds of contents had been disclosed in Korean Registered Utility Model No. 28-0475601 applied by and issued to the applicant of the present application.

The cosmetic container according to the related art includes a first content receiving member 1 containing content 1 and including an upper separation cap 1*a* and a lower fixing cap 1*b*; a second content container body 2 for containing content 2; a mixing outlet part 4 provided on a lower portion of the second content container body and serving as an outlet of mixed content 3 obtained by mixing the content 1 and the content 2; a pump housing 5 coupled to an upper end of the first content receiving member and provided on both sides thereof with guide projections which are fitted into a lift spiral groove of a lift guide tube 6 and a vertical groove of a shoulder 7; an airless pump 8 coupled to an inside of the pump housing; and a push button 9 formed on an upper end of the airless pump.

Therefore, when the shoulder 7 is rotated, while the first content receiving member 1 is divided into upper and lower parts, the content 1 is mixed with the content 2 contained in the second content container body 2, and at the same time, the push button 9 protrudes upwardly of the cosmetic container.

However, according to the above-mentioned related art, the discharge tube 1*c*, which passes through the upper separation cap 1*a* while being connected to the lower side of the airless pump 8 and is inserted into the lower fixing cap 1*b*, is additionally formed to serve as the moving passage of the mixed contents 3, so that the assembling process of the product is complicated and thus, the productivity of the product is deteriorated.

In addition, according to the related art, since a sealing structure is not provided between the pump housing 5 and the lift guide pipe 6, the content leaks through the gap between the pump housing 5 and the lift guide pipe 6. Even though an O-ring is further coupled into the gap, the O-ring is pulled up when the pump housing 5 moves slidingly.

In addition, according to the related art, since the O-ring 3 is mounted on one side of the lower fixing cap 1*b* in order to seal the first content receiving member 1, it is difficult to assemble the O-rings 3 to the lower fixing cap 1*b*, so that a defective product may be produced.

SUMMARY

To solve the problems described above, an object of the present invention is to provide a heterogeneous contents mixing container with improved productivity and sealing ability, where a first content receiving member is divided into an upper part and a lower part while rotating a shoulder formed on an outer side of the mixing container and at the same time, a push button coupled to an upper end of a pump is exposed to an upper part of the mixing container. In addition, the first content receiving member includes an upper separation cap and a lower fixing cap, and first and second connection pipes are integrally formed on the upper separation cap and the lower fixing cap, respectively. The process of assembling a content suction passage is simplified by directly inserting the second connection pipe into the first connection pipe to form the contents suction passage, thereby improving the productivity and the sealing ability of the product.

In addition, another object of the present invention is to provide a heterogeneous contents mixing container with improved productivity and sealing ability, where a sealing ring is formed on a lower fixing cap of a first content receiving member through a dual injection or insert injection process to be tightly closed to an upper separation cap, and a sealing member is formed on a lower side of a pump housing through a dual injection or insert injection process to be tightly closed to an inner periphery of a lift guide member, thereby improving the sealing ability of the first content receiving member and preventing the content from leaking through a gap between the pump housing and the lift guide member.

According to the present invention, there is provided a heterogeneous contents mixing container with improved productivity and sealing ability, which includes:

a container body (10) for containing a second content;

a first, content receiving member (20) formed in the container body (10) to contain a first content and including an upper separation cap (22) and a lower fixing cap (24);

a shoulder (30) rotatably coupled to the container body (10);

a lift guide member (40) fixed to the container body (10) and formed with a spiral groove (42);

a lift member (50) moving up by a rotation of the shoulder (30) and formed with a lift protrusion (52);

a pump housing (60) moving up with the lift member (50);

a discharge pump (70) moving up with the pump housing (60) to pump the first and second contents mixed with each other; and a push button (80) coupled to the discharge pump (70) to be movable up or down and formed with a discharge outlet (82), wherein a first connection pipe (222) is integrally formed on the upper separation cap (22) of the first content receiving member (20), a second connection pipe (242) is integrally formed on the lower fixing cap (24) and inserted into the first connection pipe.

a sealing ring (26) is formed in the lower fixing cap (24) of the first content receiving member (20) through a dual injection or insert injection process and tightly closed to an inner periphery of the upper separation cap (22), and a sealing member (62) is formed at a lower side of the pump housing (60) through a dual injection or insert injection process and tightly closed to an inner periphery of the lift guide member (40).

The heterogeneous contents mixing container may further include a lower cap (90) coupled to a lower side of the container body (10), wherein a suction space (92) is formed in the lower cap (90).

The container body (10) may be formed on a lower end thereof with a though-hole (12) through which the lower fixing cap (24) passes to be fixed, and a suction space inlet (14) may be formed between the though-hole (12) and the lower fixing cap (24).

The lift member (50) may be formed on an inner periphery thereof with a first latch protrusion wheel (54).

The pump housing (60) may be formed on an outer periphery thereof with a second latch protrusion wheel (64).

The pump housing (60) may be formed on an inner periphery thereof with a third latch protrusion wheel (66).

The upper separation cap (22) may be formed on an outer periphery of an upper portion thereof with a fourth latch protrusion wheel (226).

According to the present invention, the heterogeneous contents mixing container with improved productivity and sealing ability includes the first content receiving member including the upper separation cap and the lower fixing cap, and the first and second connection pipes which are integrated with the upper separation cap and the lower fixing cap, respectively, where the second connection pipe is directly inserted into the first connection pipe to form the content suction passage, so that the process of assembling the content suction passage is simple, thereby improving the product productivity.

In addition, according to the heterogeneous contents mixing container with improved productivity and sealing ability, the sealing ring is formed on the lower fixing cap of the first content receiving member through a dual injection or insert injection process to be tightly closed to the upper separation cap, and the sealing member is formed on the lower side of the pump housing through a dual injection or insert injection process to be tightly closed to the inner periphery of the lift guide member, thereby improving the sealing ability of the first content receiving member and preventing the content from leaking through the gap between the pump housing and the lift guide member.

DETAILED DESCRIPTION OF THE EMBODIMENTS

Hereinafter, a heterogeneous contents mixing container with improved productivity and sealing ability according to an embodiment of the present invention will be described with reference to accompanying drawings.

Figure 3:
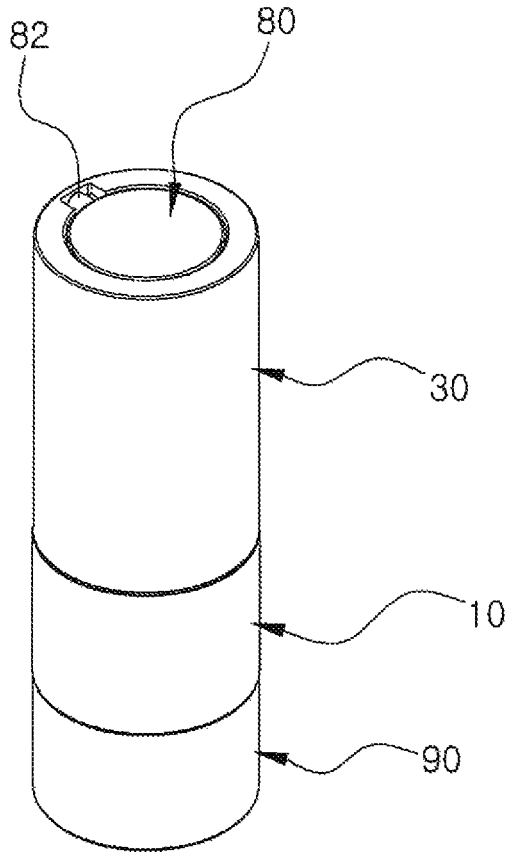
FIG. 3 is a perspective view showing a heterogeneous contents mixing container with improved productivity and sealing ability according to an embodiment of the present invention.
Figure 4:
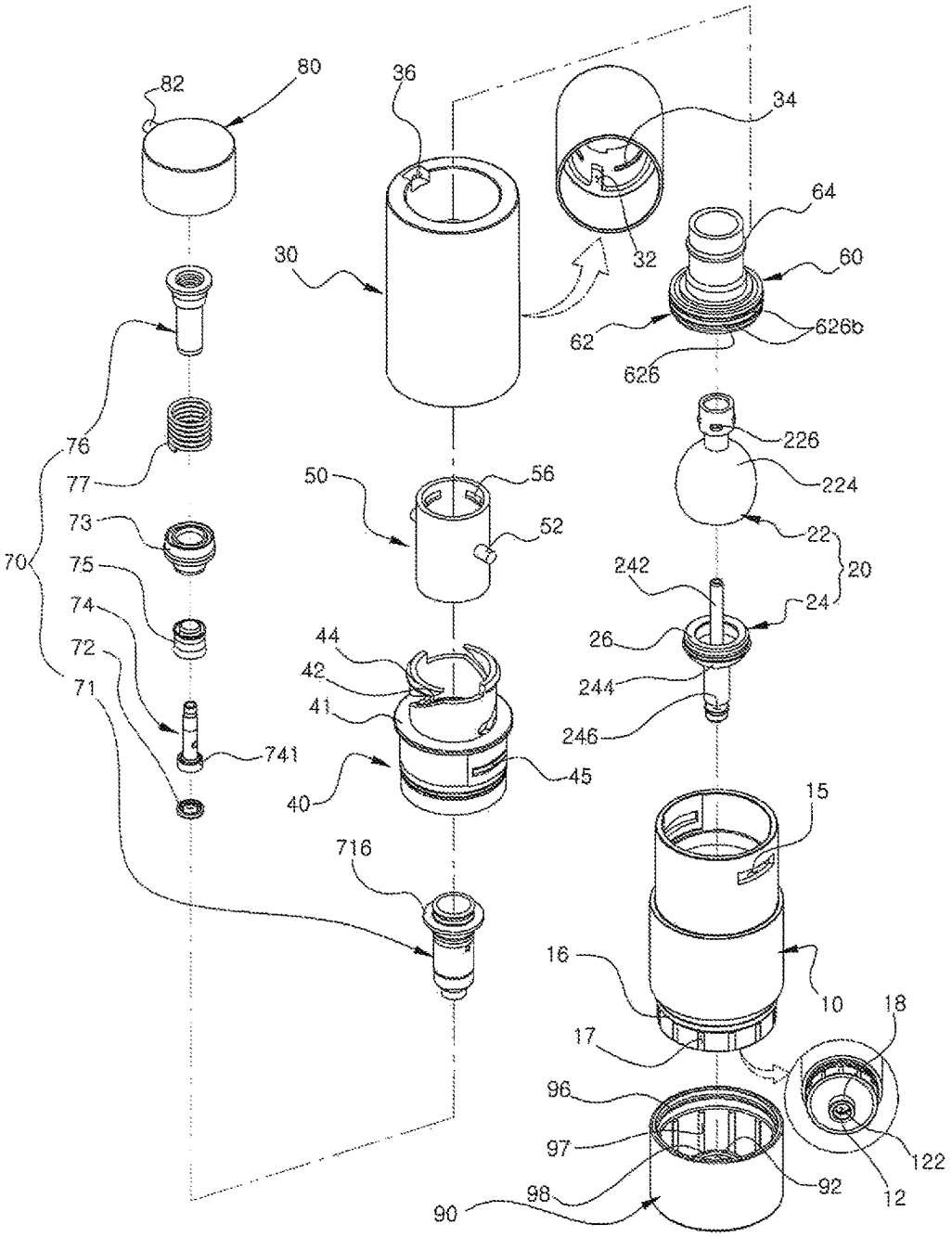
FIG. 4 is an exploded perspective view showing a heterogeneous contents mixing container with improved productivity and sealing ability according to an embodiment of the present invention.
Figure 5:
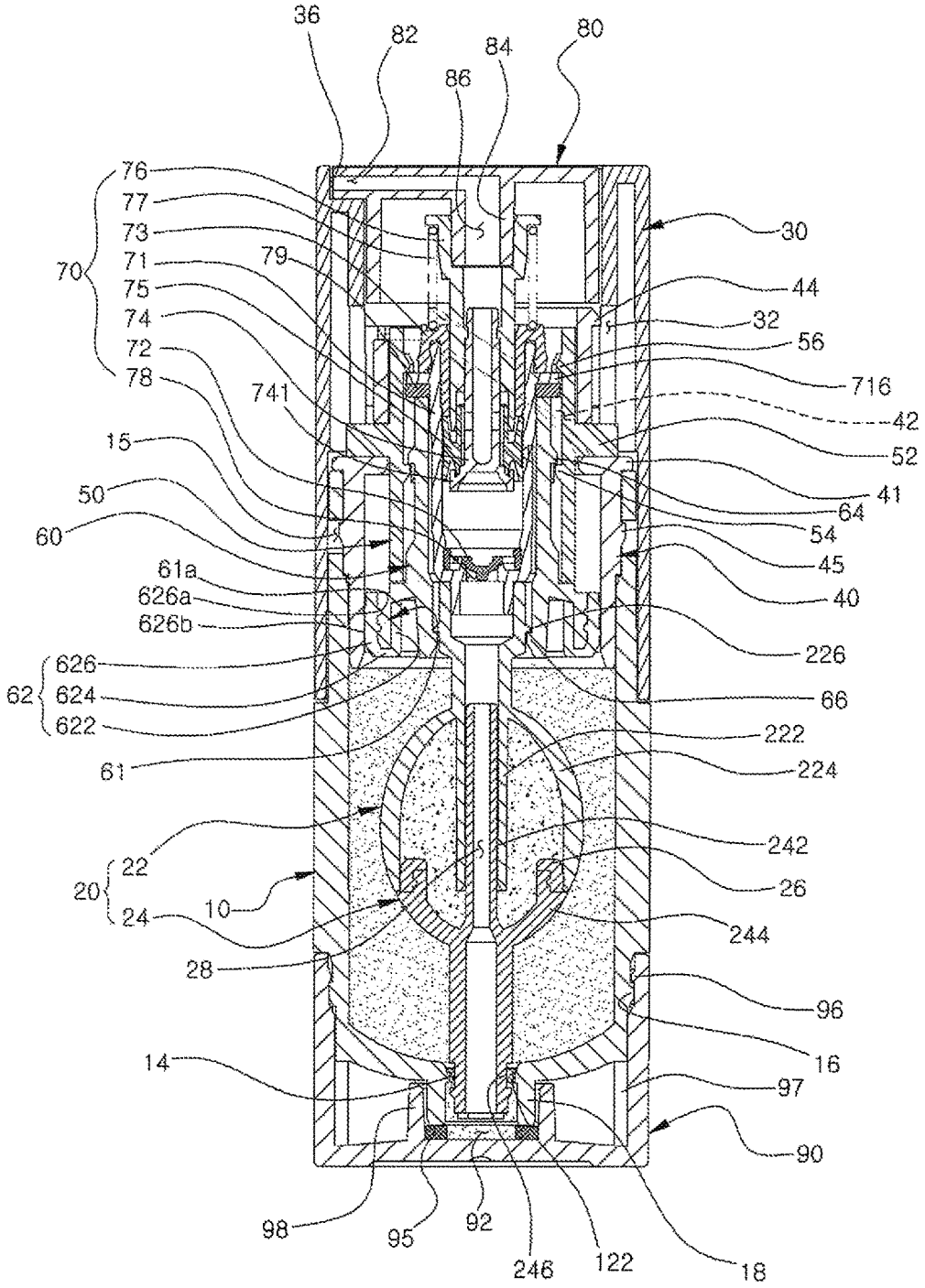
FIG. 5 is a sectional view showing a heterogeneous contents mixing container with improved productivity and sealing ability according to an embodiment of the present invention.

FIG. 3 is a perspective view showing a heterogeneous contents mixing container with improved productivity and sealing ability according to an embodiment of the present invention. FIG. 4 is an exploded perspective view showing a heterogeneous contents mixing container with improved productivity and sealing ability according to an embodiment of the present invention. FIG. 5 is a sectional view showing a heterogeneous contents mixing container with improved productivity and sealing ability according to an embodiment of the present invention.

According to an embodiment of the present invention, there is provided a heterogeneous contents mixing container with improved productivity and sealing ability, which includes a container body 10 for containing a second content; a first content receiving member 20 formed in the container body 10 to contain a first content and including an upper separation cap 22 and a lower fixing cap 24; a shoulder 30 rotatably coupled to the container body 10; a lift guide member 40 fixed to the container body 10 and formed with a spiral groove 42; a lift member 50 moving up by a rotation of the shoulder and formed with a lift protrusion 52; a pump housing 60 moving up with the lift member 50; a discharge pump 70 moving up with the pump housing 60, the discharge pump 70 pumps the first and second contents mixed with each other; and a push button 80 coupled to the discharge pump 70 to be movable up or down and formed with a discharge outlet 82.

A second content is contained in the container body 10, and a coupling hole 15, to which the elevation guide member 40 is coupled, is formed on an upper portion of the container body 10.

A first coupling protrusion 16 is formed on an outer periphery of a lower portion of the container body 10, and a plurality of rotation preventing grooves 17 are formed on a lower side of the first coupling protrusion 16.

A lower extension part 18 extending downwardly is formed on a lower end of the container body 10. A through-hole 12 is formed inside the lower extension part 18 such that the lower fixing cap 24 passes through the through-hole 12 to be fixed.

A plurality of through-hole protrusions 122 is formed on an inner periphery of the through-hole 12. The through-hole protrusions 122 protrude toward the inside of the through-hole 12. A suction space inlet 14, through which the first and second contents are input while being mixed is formed between the through-hole protrusions 122.

A lower cap 90 for closing a lower portion of the container body 10 may be further coupled to a lower side of the container body 10.

A second protrusion 96 is formed on an inner periphery of an upper portion of the lower cap 90 and is under-cut-coupled to the first coupling protrusion 16 of the container body 10.

A plurality of rotation preventing protrusions 97, which holds the lower cap 90 such that the lower cap 30 is prevented from being rotated with no traction is formed on a lower side of the second coupling protrusion 96. The rotation preventing protrusions 97 are inserted into rotation preventing grooves 17 of the container body 10.

An upper extension part 98 extending upwardly is formed on an inside of the lower cap 90, such that the lower extension part 18 is fitted into an inside of the lower cap 90.

A suction space 92 is formed inside the upper extension part 98. The first and second contents mixed with each other in the container body 10 are temporarily stored in the suction space 92 by the discharge pump 70.

A sealing ring 95 made of an elastic material may be further formed in the suction space 92 to maintain the sealing of the suction space 92. An outer periphery of the sealing ring 95 is tightly closed to an inner periphery of the upper extension part 98 of the lower cap 90 and an upper surface of the sealing ring 95 is tightly closed to a lower end of the lower extension part 18 of the container body 10.

The first content receiving member 20 is formed in the container body 10 and contains the first content therein.

The first content receiving member 20 includes the upper separation cap 22 and the lower fixing cap 24. The upper separation cap 22 and the lower fixing cap 24 coupled to each other are separated from each other at the time of use, so that the first content contained in the first content receiving member 20 is mixed with the second content contained in the container body 10.

The upper separation cap 22, which is coupled to the pump housing 60, moves upwardly with the pump housing 60 when the shoulder 30 is rotated.

A plurality of fourth latch protrusion wheels 226 is formed on an outer periphery of an upper portion of the upper separation cap 22. An upper receiving member 224 having a hemispherical shape convex upwardly is formed on a lower side of the fourth latch protrusion wheel 226. A first connection pipe 222 extends downwardly from the center of the inside of the upper receiving member 224.

The lower fixing cap 24 is fixed while passing through the through-hole 12 of the container body 10.

A fixing groove 246 into which a through-hole protrusion 122 of the container body 10 is formed on an outer periphery of the lower portion of the lower fixing cap 24. A lower receiving member 244 having a hemispherical shape concaved upwardly is formed on an upper side of the lower fixing cap 24. A second connection pipe 242 extends upwardly from the center of the inside of the lower receiving member 244.

A sealing ring 26 made of an elastic material is formed on the upper portion of the lower receiving member 244 of the lower fixing cap 24 through a dual injection or insert injection process such that the sealing ring 26 is tightly closed to an inner periphery of the upper receiving member 224 of the upper separation cap 22.

Thus, the sealing ability and productivity of the first content receiving member 20 including the upper separation cap 22 and the lower fixing cap 24 are improved.

Figure 1:
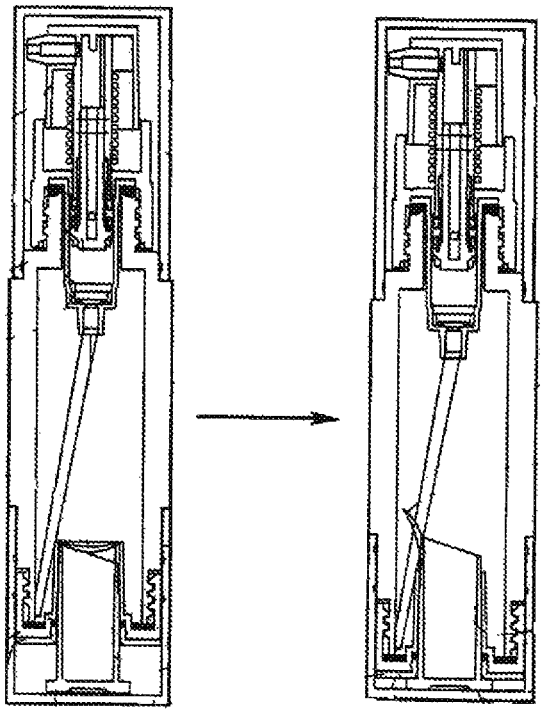
FIG. 1 is a view showing a heterogeneous contents mixing container according to the related art.
Figure 2:
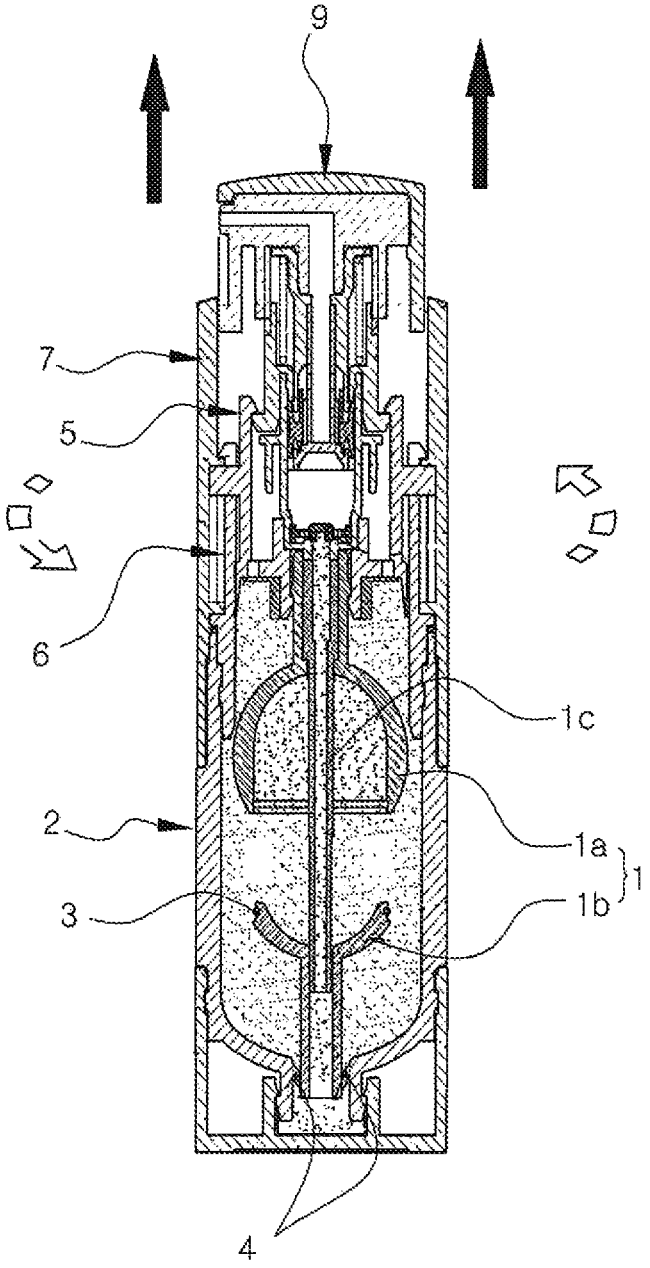
FIG. 2 is a view showing a cosmetic Container for mixing two kinds of contents according to the related art.

That is, according to the related art, as shown in FIG. 2, since the O-ring 3 is coupled to the lower fixed cap 24, the assembly process for fitting the lower fixing cap 24 with the O-ring 3 is not easy, so that defective products are frequently generated, thereby deteriorating the product productivity. However, according to the present invention, since the sealing ring 26 is formed on the lower fixing cap 24 through a dual injection or insert injection process, the process of assembling the sealing ring 26 is omitted, thereby improving the product productivity. In addition, the sealing ring 26 is integrated with the lower fixing cap 24 through a dual injection or insert injection process, thereby improving the sealing ability.

In addition, the first connection pipe 222 is integrally formed on the upper separation cap 22 of the first content receiving member 20, and the second connection pipe 242 is integrally formed on the lower fixing cap 24 to be inserted into the first connection pipe 222.

That is, according to the related art, as shown in FIG. 2, the discharge Pipe 1*c*, which passes through the upper separation cap 1*a* while being connected to the lower side of the airless pump 8 and is inserted into the lower fixing cap 1*b*, is additionally formed to serve as the moving passage of the mixed contents 3, so that the assembling process of the product is complicated and thus, the productivity of the product is deteriorated.

Thus, to solve the problems, the mixing container according to the present invention includes the first and second connection pipes 222 and 242 which are integrally formed on the Upper separation cap 22 and the lower fixing cap 24, respectively. In addition, the second connection pipe 242 is directly inserted into a lower portion of the first connection pipe 222 to form a content suction passage 23, so that the process of assembling the content suction passage is simplified as compared with that of the related art, thereby improving the product productivity.

The shoulder 30 is rotatably coupled to an upper portion of the container body 10 to rotate the lift member 50.

A vertical guide groove 32 into which the lift protrusion 52 of the lift member 50 is inserted and a separation preventing protrusion wheel 34 which holds the shoulder 30 to prevent the shoulder 30 from being separated from an upper portion of the lift guide member 40 are formed on an inner periphery of the shoulder 30.

A discharge outlet inserting groove 36, into which the discharge outlet 83 of the push button 80 is inserted, is formed on one side of an upper portion of the shoulder 30.

The lift guide member 40 is fixedly coupled to the upper portion of the container body 10 such that the lift member 50 moves up while being rotated.

A receiving protrusion wheel 41, which is placed on an upper end of the container body 10, protrudes from the outer periphery of the lift guide member 40 such that the lift guide member 40 is prevented from falling down to the inside of the container body 10.

A spiral groove 42 into which the lift protrusion 52 of the lift member 50 is inserted is formed on an upper portion of the receiving protrusion wheel 41. A second separation preventing protrusion wheel 44 to which a first separation preventing protrusion wheel 34 of the shoulder 30 is latched is formed on an upper portion of the spiral groove 42.

A coupling protrusion 45 which is inserted into the coupling hole 15 of the container body 10 is formed on a lower portion of the receiving protrusion wheel 41 and is fixed such that the lift guide member 40 is prevented from being released from the container body 10 or spinning with no traction.

The lift member 50 is formed inside the lift guide member 40 and moves up while being rotated together with the shoulder 30.

The lift protrusion 52 is formed on the outer periphery of the lift member 50 and is inserted into the spiral groove 42 of the lift guide member 40 such that the lift protrusion 52 slides and moves up while being rotated by the shoulder 30.

A first latch protrusion wheel 54, which lifts up the pump housing 60 when the lift member 50 moves up, is formed on the inner periphery of the lift member 50. A first fixing protrusion wheel 56 for fixing the discharge pump 70 protrudes inwardly from on an upper side of the first latch protrusion wheel 54 .

The pump housing 60 is formed inside the lift member 50 and moves up together with the lift member 50.

A second latch protrusion wheel 64 which is latched to the first latch protrusion wheel 54 of the lift member 50 is formed on the outer periphery of the pump housing 60. A third latch protrusion wheel 66, which is latched to a fourth latch protrusion wheel 226 of the upper separation cap 22 to be lifted up with the upper separation cap 22 when the pump housing 60 moves up, protrudes inwardly from an inner periphery of a lower portion of the pump housing 60.

A sealing member coupling part 61 extends downwardly from the outer periphery of the lower portion of the pump housing 60. The sealing member 62 made of an elastic material is formed on the sealing member coupling part 61 through a dual injection or insert injection process while surrounding the sealing member coupling part 61, so that the sealing member coupling part 61 is tightly closed to the inner periphery of the lift guide member 40.

That is, the sealing member 62 prevents the contents from leaking through the gap between the pump housing 60 and the lift guide member 40 when the container body 10 is tilted or turned over.

The sealing member 62 is formed in a shape of a ring, and includes an inner ring 622, a connection part 624 extending outwardly of the inner ring 622 and an outer ring 626 extending upwardly of the connection part 624.

The sealing member coupling part 61 of the pump housing 60 is inserted between the inner ring 622 and the outer ring 626 of the sealing member 62.

A plurality of attachment protrusion wheels 626*a* is formed on an inner periphery of the outer ring 626. An attachment groove 61*a* is formed at a position corresponding to the attachment protrusion wheel 626*a*.

A sealing protrusion wheel 626*b* is formed on an outer periphery of the sealing member 62. to be tightly closed to an inner periphery of a lower portion of the lift guide member 40.

The sealing member 62, the sealing ring 26 and an airtightness ring 95 are formed of an elastic material, and preferably formed of at least one of natural rubber, elastomer, silicone rubber and acrylonitrile-butadiene rubber (NBR), polypropylene (PP), or polyethylene (PE).

The discharge pump 70 is installed inside the pump housing 60. The discharge pump 70 is lifted up together with the pump housing 60 to pump the first and second contents mixed in the container body 10.

The discharge pump 70 is coupled to an upper portion of the upper separation cap 22 while being placed on an upper end of the pump housing 60. The discharge pump 70 includes a cylinder 71 formed on a lower portion thereof with a content suction hole 78, a check valve 72 for selectively opening or closing the content suction hole 78, a sealing member 73 coupled to an upper portion of the cylinder to seal the inside of the cylinder 71, a piston 74 formed inside the cylinder 71, a piston ring 75 fitted on the outside of the piston 74 to be tightly closed to an inner side surface of the cylinder 71, a vertical moving member 76 coupled to an upper portion of the piston 74, and an elastic member 77 for elastically supporting the vertical moving member 76.

A second fiving protrusion wheel 716 which is fixedly pressed by the first fixing protrusion wheel 56 of the lift member 50 is formed on an outer periphery of an upper portion of the cylinder 71 of the discharge pump 70.

In addition, a pump sealing ring 79 may be further formed between the second fixing protrusion wheel 716 of the cylinder 71 and the upper end of the pump housing 60.

The push button 80 is coupled to an upper portion of the discharge pump 70 to be movable up or down.

The discharge outlet 82 for discharging the content pumped by the discharge pump 70 is formed on one side of the push button 80.

A pump coupling part. 84 which extends downwardly is formed on an inside of the push button 80 and is coupled to the vertical moving member 76 of the discharge pump 70. A discharge passage 86 is formed in the pump coupling part 84.

Hereinafter, a method of assembling a heterogeneous contents mixing container with improved productivity and sealing ability according to an embodiment of the present invention will be described in detail.

To assemble the heterogeneous contents mixing container with improved productivity and sealing ability according to the present invention, as shown in FIGS. 4 and 5, after the airtightness ring 95 is first fitted into the inside of the upper extension part 98 of the lower cap 90 and the lower cap 30 is coupled to the lower side of the container body, the inside of the container body 10 is filled with the second content, When the lower cap 90 is coupled to the container body 10, the first coupling protrusion 16 of the container body 10 is under-cut-coupled to the second coupling protrusion 96 of the lower cap 90 while the rotation preventing protrusion 97 is inserted into the rotation preventing groove 17 of the container body 10.

Next, the first content receiving member 20 is filled with the first content. The upper separation cap 22 of the first content receiving member 20 is turned over to fill the upper receiving member 224 of the upper separation cap 22 with the first content and the lower fixing cap 24 is coupled to the upper separation cap 22.

In this case, the sealing ring 26 is formed on the upper portion of the lower receiving member 244 of the lower fixing cap 24 through a dual injection or insert injection process, so that the sealing ring 26 is tightly closed to the inner periphery of the upper receiving member 224 of the upper fixing cap 22.

Then, the first content receiving member 20 is fitted into the lower side of the pump housing 60. The fourth latch protrusion wheel 226 of the first content receiving member 20 goes over the third latch protrusion wheel 66 of the pump housing 60.

Thereafter, the discharge pump 70 is installed, to the inside of the pump housing 60, and the pump housing 60 is inserted into the lower portion of the lift guide member 40.

In this case, the sealing member 62 is formed on the sealing member coupling part 61 of the pump housing 60 through a dual injection or insert injection process such that the sealing member 62 is tightly closed to the inner periphery of the lift guide member 40, Then, while the lift member 50 is inserted between the lift guide member 40 and the pump housing 60, the lift member 50 is coupled to the pump housing 60. The lift protrusion 52 of the lift member 50 is inserted into the spiral groove 42 of the lift guide member 40, and the first latch protrusion wheel 54 of the lift member 50 goes over the second latch protrusion wheel 64 of the pump housing. The first fixing protrusion wheel 56 of the lift member 50 presses the upper end of the second fixing protrusion wheel 716 of the discharge pump 70 to fix the second fixing protrusion -wheel 716.

Then, the lift guide member 40 assembled as described above is coupled to the upper portion of the container body 10. The coupling protrusion 45 of the lift guide member 40 is coupled to the coupling hole 15 of the container body 10 and at the same time, the receiving protrusion wheel 41 of the lift guide member 40 is placed on the upper end of the container body 10.

In addition, while the lower side of the lower fixing cap 24 passes through the through-hole 12 of the container body 10, the through-hole protrusion 122 of the through-hole 12 is fitted into the fixing groove 246 of the lower fixing cap 24, thereby forming the inlet 14 through which the first and second contents are supplied into the suction space 92 of the lower cap 90.

Then, the shoulder 30 is coupled to the upper side of the lift guide member 40. The lift protrusion 52 of the lift member 50 is inserted into the vertical guide groove 32 of the shoulder 30 and the first separation preventing protrusion wheel 34 of the shoulder 30 goes over the second separation preventing protrusion wheel 44 of the lift guide member 40.

Last, the push button 80 is coupled to the upper portion of the shoulder 30. The pump coupling part 84 of the push button 80 is coupled to the vertical moving member 76 of the discharge pump 70, and the discharge outlet 82 is inserted into the discharge outlet inserting groove 36 of the shoulder 30, so that the assembling of the heterogeneous contents mixing container with improved productivity and sealing ability according to the present invention is completed.

Hereinafter, a method of using the heterogeneous contents mixing container with improved productivity and sealing ability assembled as described above will be described in detail with reference to accompanying drawings.

Figure 6:
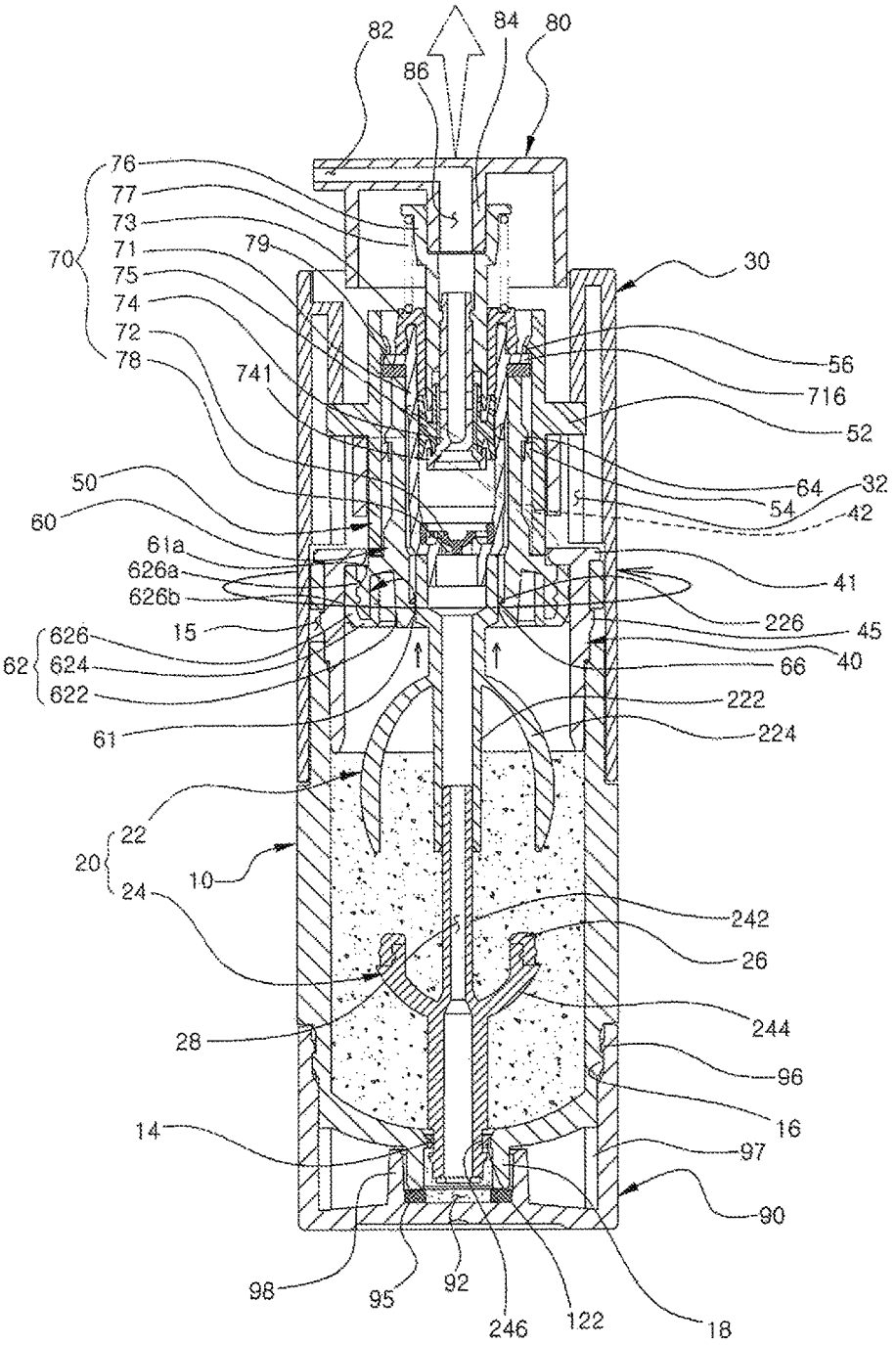
FIG. 6 is a sectional view showing a state in which heterogeneous contents are mixed and at the same time, a push button appears or disappears by rotating the shoulder of a heterogeneous contents mixing container with improved productivity and sealing ability according to an embodiment of the present invention.
Figure 7:
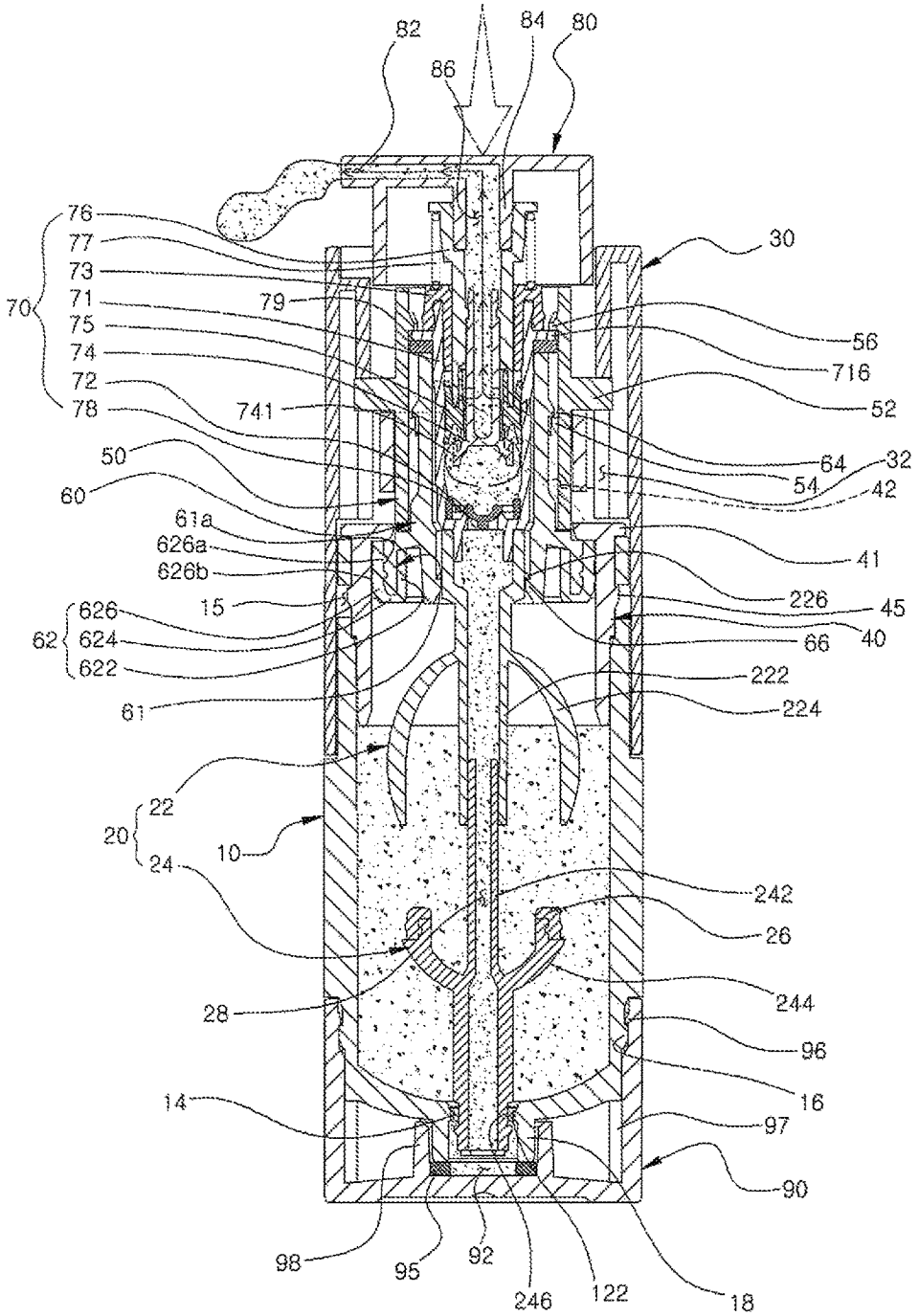
FIG. 7 is a cross-sectional view showing a state in which the mixed contents are discharged by pushing a push button of a heterogeneous contents mixing container with improved productivity and sealing ability according to the present invention.
Figure 8:
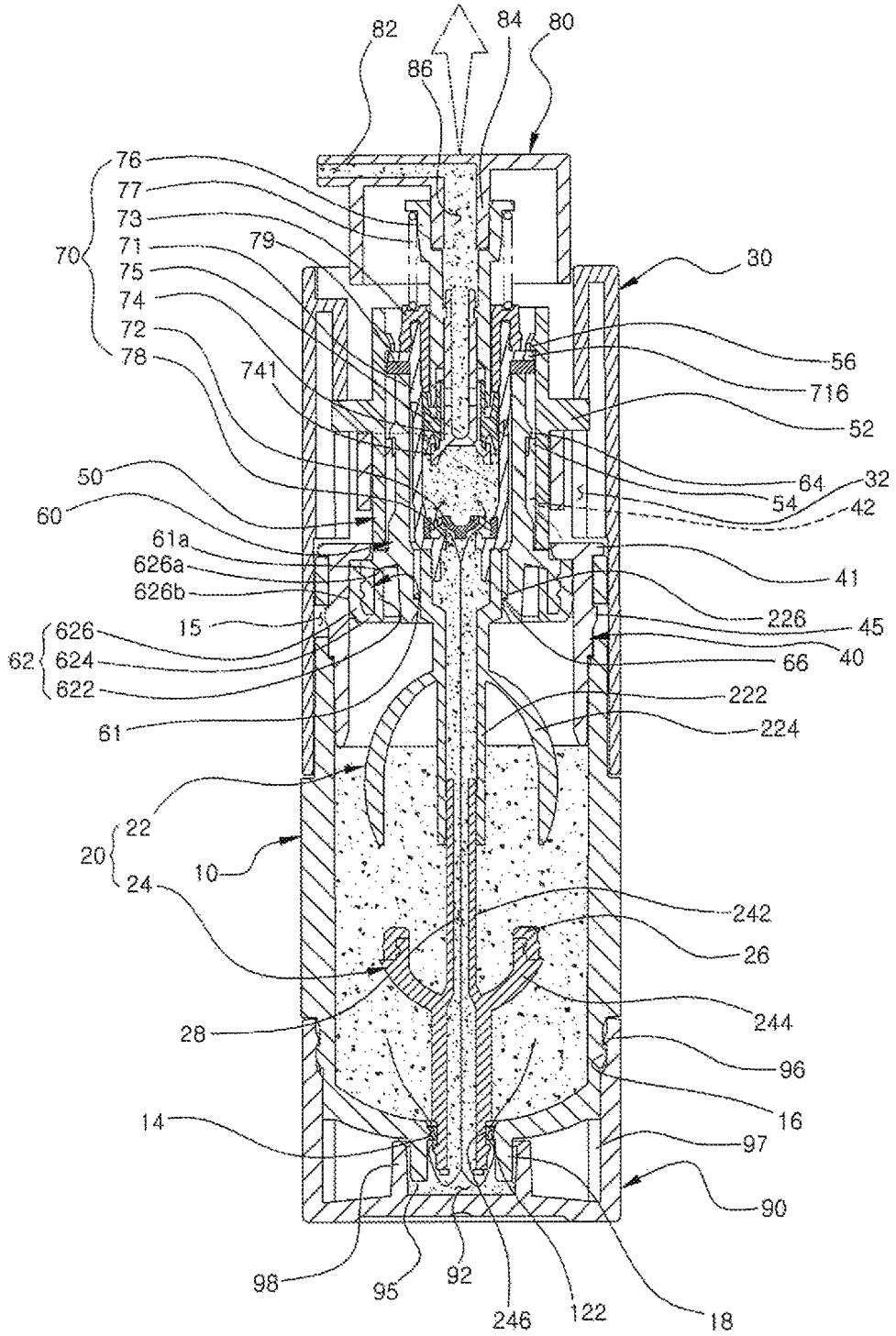
FIG. 8 is a sectional view showing a state in which the mixed contents are sucked while a push button of a heterogeneous contents mixing container with improved productivity and sealing ability according to the present invention is raised.

FIG. 6 is a sectional view showing a state in which heterogeneous contents are mixed and at the same time, a push button appears or disappears by rotating the shoulder of a heterogeneous contents mixing container with improved productivity and sealing ability according to an embodiment of the present invention. FIG. 7 is a cross-sectional view showing a state in which the mixed contents are discharged by pushing a push button of a heterogeneous contents mixing container with improved productivity and sealing ability according to the present invention. FIG. 8 is a sectional view showing a state in which the mixed contents are sucked while a push button of a heterogeneous contents mixing container with improved productivity and sealing ability according to the present invention is raised.

To use the heterogeneous contents mixing container with improved productivity and sealing ability according to the present invention, the container body 10 is first held with one hand, and the shoulder 30 is rotated counterclockwise with the other hand.

As shown in FIG. 6, when the shoulder 30 is rotated counterclockwise, the lift member 50 is rotated together with the shoulder 30. In this case, while the lift protrusion 52 of the lift member 50 slides in the state that the lift protrusion 52 is inserted into the spiral groove 42 of the lift guide member 40, the lift protrusion 52 moves up.

As described above, when the lift member 50 moves up, the first latch protrusion wheel 54 lifts up the second latch protrusion wheel 64 of the pump housing 60 and, at the same time, the third latch protrusion wheel 66 of the pump housing 60 lifts up the fourth latch protrusion wheel 226 of the upper separation cap 22, such that the pump housing 60, the discharge pump 70 and the upper separation cap 22 move up together with the lift member 50.

In this case, since, the lower fixing cap 24 is fixed by the through-hole protrusion 122 of the container body 10, while the upper separation cap 22 and the lower fixing cap 24 are separated from each other, the first content contained in the first content receiving member 20 is mixed with the second content contained in the container body 10.

Thereafter, as shown in FIG. 7, when the push button 30 is pushed, while the push button 80 moves down, the vertical moving member 76 and the piston 74 of the discharge pump 70 coupled to the lower portion of the push button 80 move down.

In this case, since the piston 75 of the discharge pump 70 is tightly closed to the inner side surface of the cylinder 71, while only the piston 74 moves down, a gap is generated between the piston 74 and the piston ring 75 so that the content discharge passage is generated.

Then, when the push button 80 is continuously pushed, the piston ring 75 is pressed by the lower end of the vertical moving member 76, so that the volume of the cylinder 71 is reduced as the piston ring 75 moves down together with the piston 74. Thus, while the content suction hole 78 of the check valve 72 is closed by the discharge pressure in the cylinder 71, the content contained in the cylinder 71 is output between the piston 74 and the piston ring 75, so that the content passes through the content discharge passage 86 of the push button 80 and discharged through the discharge outlet 82.

As shown in FIG. 8, if the pressure on the push button 80 is released, the push button 80 move up by the elasticity of the elastic member 77 elastically supporting the push button 80 and the vertical moving member 76 coupled to the lower side of the push button 80 and the piston 74 also move up. In this case, as the expansion protrusion wheel formed on the lower end of the outer side of the piston 74 lifts up the piston ring 75, while the gap between the piston 74 and the piston ring 75 is blocked, the piston 74 and the piston ring 75 move up together, so that the volume of the cylinder is increased, thereby generating a vacuum pressure.

Thereafter, while the check valve 72 is lifted up by the vacuum pressure generated from the inside of the cylinder 71, the content suction hole 78 formed on the bottom surface of the cylinder 71 is opened, so that the first and second contents mixed in the container body 10 are introduced into the cylinder 71.

In this case, after the first and second contents mixed in the container body 10 are introduced into the suction space 92 through the suction space inlet 13, the first and second contents are introduced into the cylinder through the suction passage 28 formed by the first connection pipe 222 of the upper separation cap 22 and the second connection pipe 242 of the lower fixing cap 24.

As described above, the heterogeneous contents mixing container with improved productivity and sealing ability described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

What is claimed is:

1. A heterogeneous contents mixing container comprising:

a container body (10) for containing a second content;

a first content receiving member (20) formed in the container body (10) to contain a first content and including an upper separation cap (22) and a lower fixing cap (24);

a shoulder (30) rotatably coupled to the container body (10);

a lift guide member (40) fixed to the container body (10) and formed with a spiral groove (42);

a lift member (50) moving up by a rotation of the shoulder (30) and formed with a lift protrusion (52);

a pump housing (60) moving up with the lift member (50);

a discharge pump (70) moving up with the pump housing (60) to pump the first and second contents mixed with each other; and a push button (80) coupled to the discharge pump (70) to be movable up or down and formed with a discharge outlet (82), wherein a first connection pipe (222) is integrally formed on the upper separation cap (22) of the first content receiving member (20), a second connection pipe (242) is integrally formed on the lower fixing cap (24) and inserted into the first connection pipe (222), a sealing ring (26) is formed in the lower fixing cap (24) of the first content receiving member (20) through a dual injection or insert injection process and closed to an inner periphery of the upper separation cap (22), and a sealing member (62) is formed at a lower side of the pump housing (60) through a dual injection or insert injection process and closed to an inner periphery of the lift guide member (40).

2. The heterogeneous contents mixing container of claim 1, further comprising a lower cap (90) coupled to a lower side of the container body (10), wherein a suction space (92) is formed in the lower cap (90).

3. The heterogeneous contents mixing container of claim 1, wherein the container body (10) is formed on a lower end thereof with a though-hole (12) through which the lower fixing cap (24) passes to be fixed, and a suction space inlet (14) is formed between the though-hole (12) and the lower fixing cap (24).

4. The heterogeneous contents mixing container of claim 1, wherein the lift member (50) is formed on an inner periphery thereof with a first latch protrusion wheel (54), the pump housing (60) is formed on an outer periphery thereof with a second latch protrusion wheel (64), the pump housing (60) is formed on an inner periphery thereof with a third latch protrusion wheel (66), and the upper separation cap (22) is formed on an outer periphery of an upper portion thereof with a fourth latch protrusion wheel (226).

5. The heterogeneous contents mixing container of claim 1, wherein the sealing member (62) includes an inner ring (622), a connection part (624) extending outwardly of the inner ring (622), and an outer ring (626) extending upwardly of the connection part (624), and a sealing member coupling part (61) of the pump housing (60) is inserted between the inner ring (622) and the outer ring (626).

* * * * *